United States Patent [19]

Watanabe et al.

[11] Patent Number: 4,489,337

[45] Date of Patent: Dec. 18, 1984

[54] HEAT-SENSITIVE RECORDING PAPER

[75] Inventors: Shojiro Watanabe; Hiroharu Matsukawa, both of Shizuoka, Japan

[73] Assignee: Fuji Photo Film Co., Ltd., Kanagawa, Japan

[21] Appl. No.: 553,920

[22] Filed: Nov. 21, 1983

[30] Foreign Application Priority Data

Nov. 22, 1982 [JP] Japan ..... 57-205269

[51] Int. Cl.[3] ..... B41M 5/18

[52] U.S. Cl. ..... 346/209; 346/208; 346/216

[58] Field of Search ..... 346/208, 209, 216

[56] References Cited

FOREIGN PATENT DOCUMENTS 0039139 4/1978 Japan ..... 346/208
0009827 1/1980 Japan ..... 346/209

*Primary Examiner*—Bruce H. Hess
*Attorney, Agent, or Firm*—Sughrue, Mion, Zinn, Macpeak, and Seas

[57] ABSTRACT

A heat-sensitive recording paper is disclosed. The paper is comprised of a support base having provided thereon, an almost colorless electron donating dye, an organic acid capable of coloration upon contacting the dye and a phenolic compound. The phenolic compound is represented by the general formula (I):

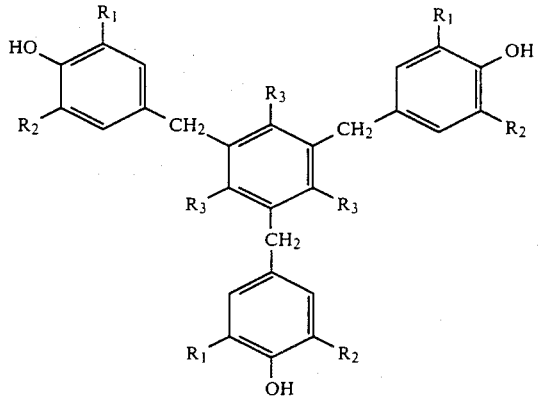

(I)

wherein $R_1$ is a branched alkyl group having 3 to 8 carbon atoms, $R_2$ is a hydrogen atom or a branched alkyl group having 3 to 8 carbon atoms and $R_3$ is a hydrogen atom or a methyl group. The paper is capable of producing clear images without fogging and the images produced undergo a reduced amount of fading due to the influence of humidity or heat.

7 Claims, No Drawings

HEAT-SENSITIVE RECORDING PAPER

FIELD OF THE INVENTION

The present invention relates to a heat-sensitive recording paper and, more particularly, relates to a heat-sensitive recording paper in which the fading of recorded images is prevented.

BACKGROUND OF THE INVENTION

Heat-sensitive recording papers mean those in which images are formed utilizing the physical and/or chemical change(s) in the materials induced by heat energy. A large number of processes relating to such papers have been investigated.

Recently, heat-sensitive recording papers have been employed for the output of facsimiles, and the output or recording paper of electronic computers because these papers are characterized by being based on primary coloration not requiring developing process and so on. These recording papers are called "dye-type papers" and are disclosed in Japanese Patent Publication Nos. 4160/68 and 1403/70 (corresponding to U.S. Pat. Nos. 2,663,654 and 2,967,785), and Japanese Patent Application (OPI) No. 27253/80 (corresponding to U.S. Pat. No. 4,283,458) (the term "OPI" as used herein refers to a "published unexamined Japanese patent application"), etc.

In general, there exists an advantage that the recording devices can be lighten and be smaller size, when a heat-sensitive recording paper is employed as a recording paper. Accordingly, this recording paper has come to be widely used. On the other hand, heat-sensitive recording paper is not desirable because the recorded image obtained fades away due to the influence of the external conditions, i.e., humidity, heat, etc. The fading of the recorded image is a serious defect during practical applications and there are various proposals for the improvement of this point.

There exist some descriptions relating to the addition of a phenol derivative such as 2,2'-methylene-bis(4-methyl-6-tert-butylphenol), etc., described in Japanese Patent Publication No. 43386/76 (corresponding to U.S. Pat. No. 3,937,864), the addition of a water-insoluble modified phenol resin such as one modified by rosin described in Japanese Patent Application (OPI) No. 17347/78, the addition of a terephthalic acid ester such as diethyl terephthalate described in Japanese Patent Application (OPI) No. 72996/81 and so on. However, all these methods are insufficient in the prevention of the fading and furthermore possess a defect that undesired coloring so called "fog" appeared in the process of the recording paper production or during the preservation of the recording paper. This fog can be substantially increased especially under the influence of high humidity and heat, and thus commercial value decreases greatly under such conditions.

SUMMARY OF THE INVENTION

A primary object of the present invention is to provide a heat-sensitive recording paper which shows no fogging and little fading of recorded images due to the influence of humidity or heat.

The above-mentioned object of the present invention was achieved by a heat-sensitive recording paper which comprises an almost colorless electron donating dye (color former), an organic acid which can cause coloration by contacting with said dye, and a phenolic compound represented by the following general formula (I).

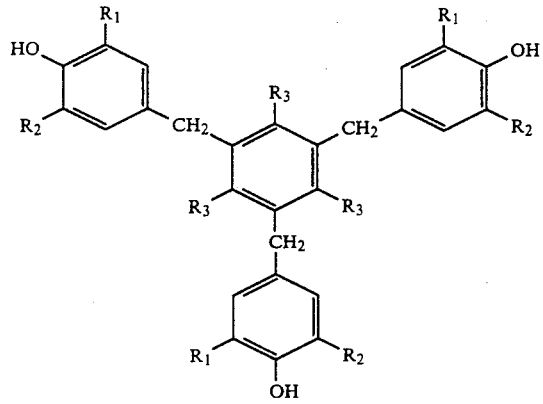

(I)

wherein $R_1$ stands for a branched alkyl group having 3 to 8 carbon atoms, preferably 4 carbon atoms, $R_2$ stands for a hydrogen atom or a branched alkyl group having 3 to 8 carbon atoms, preferably 4 carbon atoms, and $R_3$ stands for a hydrogen atom or a methyl group.

DETAILED DESCRIPTION OF THE INVENTION

A tertiary butyl group, an isobutyl group, an isopropyl group and a tertiary octyl group are preferred as the branched alkyl groups represented by $R_1$ or $R_2$ in the above-mentioned general formula (I), most preferably a tertiary butyl group. Typical instances of a phenolic compound which can be used in the present invention represented by the general formula (I) are as follows:

(i) 1,3,5-trimethyl-2,4,6-tris(3,5-di-tert-butyl-4-hydroxybenzyl)benzene (ii) 2,4,6-tris(3,5-di-tert-butyl-4-hydroxy-benzyl)benzene (iii) 1,3,5-trimethyl-2,4,6-tris(3-tert-butyl-4-hydroxybenzyl)benzene The phenolic compound (i) is more preferred. The phenolic compounds represented by the general formula (I) are used in an amount of 5 to 200 wt%, preferably 20 to 100 wt% based on the weight of the organic acid used. Further, the phenolic compounds preferably have a water solubility of 0.1 wt% or less at an ordinary temperature.

The typical electron donating dyes that can be used in the present invention include (1) triarylmethane type, (2) diphenylmethane type, (3) xanthene type, (4) thiazine type and (5) spiropyran type. Other specific examples include those described in U.S. Pat. No. 4,283,458. The color former is preferably used in an amount of 0.3 to 1 g/m$^2$. Specific examples of triarylmethane compounds include 3,3-bis(p-dimethylaminophenyl)-6-dimethylaminophthalide (namely, Cristal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide and 3-p-dimethylaminophenyl-3-(1-methylpyrrol-2-yl)-6-dimethylaminophthalide. Specific examples of diphenylmethane compounds include 4,4'-bisdimethylaminobenzhydrin benzyl ether, N-halophenyl leuco Auramine and N-2,4,5-trichlorophenyl leuco Auramine. Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino(3-acetylmethylamino)fluoran, 7-diethylamino(3-methylamino)fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran and 7-diethylamino-3-(diethylamino)fluoran. Specific examples of thiazine compounds include benzoyl leuco Methylene Blue and p-nitrobenzyl leuco Methylene Blue. Specific examples of spiropyran compounds include 3-methyl-spirodinaphthopyran, 3-ethyl-spiro-dinaphthopyran, 3,3'-dichlorospiro-dinaphthopyran, 3-benzyl-spiro-dinaphthopyran, 3-methyl-naphtho(3-methoxybenzo)spiropyran and 3-propyl-spiro-dibenzopyran. These compounds may be used alone or as a mixture.

Phenol derivatives or aromatic carboxylic acid derivatives are preferably used as the organic acid of the present invention and bisphenols are especially preferred. The organic acids are preferably used in an amount of 2 to 5 parts by weight per 1 part by weight of the color former. Concrete examples of the phenols include p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethyl-hexane, 2,2-bis(4-hydroxy-3,5-dichlorophenyl)-propane and the like.

Useful aromatic carboxylic acid derivatives include benzyl p-hydroxybenzoate, ethyl p-hydroxybenzoate, butyl p-hydroxybenzoate, 3,5-di-tert-butylsalicylic acid, 3,5-di-α-methylbenzylsalicylic acid and the polyvalent metal salts of said carboxylic acids.

It is necessary to disperse the above-mentioned materials using water as a dispersing medium in the production of coating solution for heat-sensitive recording paper. At this time, it is favorable to employ a water-soluble polymer such as polyvinyl alcohol, hydroxyethyl cellulose, a starch derivative and the like. The dispersing method of the materials for heat-sensitive recording paper using these dispersing media is as follows: In general, an electron donating dye, an organic acid or a phenolic compound represented by the general formula (I) is added in an amount of 10 wt% to 50 wt% (based on the weight of the dispersion solution) to a dispersing medium containing a water-soluble polymer of 1 to 10 wt%, more favorably 2 to 5 wt% (based on the weight of the dispersion medium) and is dispersed by means of a dispersing apparatus such as ball mill, sand mill, attritor or colloid mill. Then, a coating solution for heat-sensitive recording paper is prepared by the addition of a necessary oil absorbing pigment, waxes, metal soap, etc., to the above mixed dispersion and is coated on a support to obtain the desired heat-sensitive recording paper.

The oil absorbing pigment is selected from kaolin, calcined kaolin, talc, agalmatolite, diatom earch, calcium carbonate, aluminum hydroxide, magnesium hydroxide, magnesium carbonate, titanium oxide, barium carbonate, urea-formalin filler, cellulose filler and the like. Useful waxes include higher fatty acid amides such as a stearic acid amide, an ethylene bisstearamide, higher fatty acid esters and the like, as well as paraffin wax, carnauba wax, microcrystalline wax and polyethylene wax.

Examples of useful metal soaps include a higher fatty acid polyvalent metal salt such as zinc stearate, aluminum stearate, calcium stearate, zinc oleate and the like.

The present invention will be further illustrated by the following Examples, which in no way limit the scope of the present invention.

EXAMPLE 1

Dispersion (A) was obtained by dispersing 20 g of 3-diethylamino-6-chloro-7-(β-ethoxyethyl)aminofluoran into 100 g of 10% aqueous polyvinyl alcohol (saponification degree: 98%; polymerization degree: 500) in a 300 ml ball mill for about 24 hours. Similarly, dispersion (B) was obtained by dispersing 10 g of 2,2-bis(4-hydroxyphenyl)propane and 10 g of stearic acid amide into 100 g of 10% aqueous polyvinyl alcohol in a 300 ml ball mill for about 24 hours. Similarly, dispersion (C) was obtained by dispersing 20 g of 1,3,5-trimethyl-2,4,6-tris(3,5-di-tert-butyl-4-hydroxy-benzyl)benzene into 100 g of 10% aqueous polyvinyl alcohol solution in a 300 ml ball mill for about 24 hours.

The dispersion (A), the dispersion (B) and the dispersion (C) were mixed in a weight ratio of 3:20:5, respectively. Furthermore, 50 g of fine powder of calcium carbonate was added to 200 g of the above mixture and dispersed thoroughly to obtain a coating solution.

This coating solution for heat-sensitive recording paper was coated on a base paper having a basis weight of 50 g/m$^2$, in an amount of 6 g/m$^2$ as solids by means of air knife, and dried at 50° C. for 2 minutes to obtain a heat-sensitive recording paper.

EXAMPLE 2

A heat-sensitive recording paper was obtained in a manner similar to that described in Example 1 except that dispersion (A) dispersion (B) and dispersion (C) were mixed in a weight ratio of 3:20:2, respectively.

EXAMPLE 3

A heat-sensitive recording paper was obtained in a manner similar to that described in Example 1 except that a dispersion (C) was prepared using 20 g of 2,4,6-tris(3,5-di-tert-butyl-4-hydroxy-benzyl)benzene instead of 20 g of 1,3,5-trimethyl-2,4,6-tris(3,5-di-tert-butyl-4-hydroxy-benzyl)benzene.

COMPARATIVE EXAMPLE 1

The dispersion (A) and the dispersion (B) of Example 1 were mixed in a weight ratio of 3:20, respectively. To 200 g of the resulting mixture was added 50 g of fine powder of calcium carbonate and dispersed thoroughly to obtain a coating solution. A heat-sensitive recording paper was obtained by coating the above solution in a similar manner as described in Example 1.

COMPARATIVE EXAMPLE 2

A heat-sensitive recording paper was obtained in a manner similar to that described in Example 1 except that a dispersion (C) was prepared using 20 g of 2,2'-methylene-bis(4-methyl-6-tert-butylphenol) instead of 20 g of 1,3,5-trimethyl-2,4,6-tris(3,5-di-tert-butyl-4-hydroxy-benzyl)benzene.

COMPARATIVE EXAMPLE 3

A heat-sensitive recording paper was obtained in a manner similar to that described in Example 1 except that a dispersion (C) was prepared using 20 g of diethyl terephthalate instead of 20 g of 1,3,5-trimethyl-2,4,6-tris(3,5-di-tert-butyl-4-hydroxy-benzyl)benzene.

COMPARATIVE TEST

Comparative tests of heat-sensitive recording papers obtained in Examples and Comparative Examples were carried out as follows:

(1) Fog and Coloring Property:

Recording was performed by providing an energy of 2 ms/dot and 50 mJ/mm$^2$ to a recording element in a density of 5 dot/mm in main scan and 6 dot/mm in sub scan. Fog (density of background before recording) and colored image density after recording (initial density) were measured by means of a Macbeth RD-514 type reflective densitometer (visual filter was used).

(2) Moisture Resistance:

After the color image obtained at the coloring property test was allowed to stand at 20° C. in an atmosphere of RH 90% for 24 hours, fog (density of background) and color image density were measured.

The remaining ratio of the color image was calculated using the following equation:

$$\frac{\text{Density after the test of moisture resistance}}{\text{Initial density}} \times 100\ (\%)$$

(3) Thermal Resistance:

After the color image obtained at the coloring property test was allowed to stand at 60° C. in an atmosphere of RH 20% for 24 hours, fog (density of background) and color image density were measured. The remaining ratio of the color image was calculated using the following equation:

$$\frac{\text{Density after the test of thermal resistance}}{\text{Initial density}} \times 100\ (\%)$$

The results of the comparative test are shown in Table 1.

TABLE 1

| | Initial Fog and Coloring Properties | | Moisture Resistance | | | Thermal Resistance | | |
|---|---|---|---|---|---|---|---|---|
| | Fog | Density | Fog | Density | Remaining Ratio (%) | Fog | Density | Remaining Ratio (%) |
| Example 1 | 0.07 | 0.92 | 0.10 | 0.88 | 96 | 0.08 | 0.90 | 98 |
| Example 2 | 0.07 | 0.92 | 0.10 | 0.85 | 92 | 0.08 | 0.88 | 96 |
| Example 3 | 0.07 | 0.91 | 0.10 | 0.86 | 95 | 0.08 | 0.87 | 96 |
| Comparative Example 1 | 0.07 | 0.90 | 0.10 | 0.40 | 44 | 0.08 | 0.45 | 50 |
| Comparative Example 2 | 0.10 | 0.90 | 0.15 | 0.57 | 63 | 0.13 | 0.62 | 69 |
| Comparative Example 3 | 0.20 | 0.92 | 0.25 | 0.68 | 74 | 0.22 | 0.72 | 78 |

The above Table represents that the heat-sensitive recording paper of the present invention is superior to the reference heat-sensitive recording paper with respect to reducing the amount of fading of the color image due to the influence of humidity or heat while also reducing fog.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

a support base having thereon:

an almost colorless electron donating dye;

an organic acid capable of coloration upon contacting the dye; and a phenolic compound represented by the following general formula (I):

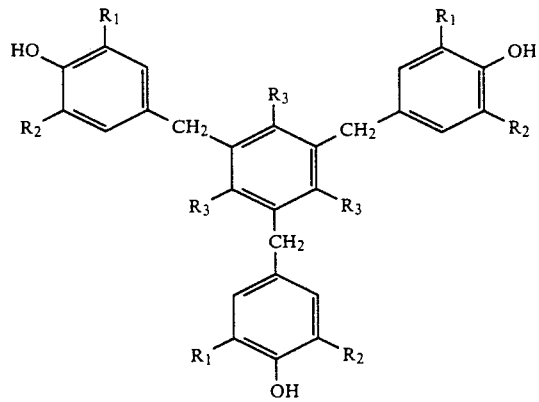

(I)

wherein $R_1$ is a branched alkyl group having 3 to 8 carbon atoms, $R_2$ is a hydrogen atom or a branched alkyl group having 3 to 8 carbon atoms, and $R_3$ is a hydrogen atom or a methyl group.

2. A heat-sensitive recording paper as claimed in claim 1, wherein $R_1$ and $R_2$ each represents a tertiary butyl group, an isobutyl group, an isopropyl group and a tertiary octyl group.

3. A heat-sensitive recording paper as claimed in claim 2, wherein $R_1$ and $R_2$ each represents a tertiary butyl group.

4. A heat-sensitive recording paper as claimed in claim 1, wherein the phenolic compound is present in the range of 5 to 200 wt% based on the weight of the organic acid.

5. A heat-sensitive recording paper as claimed in claim 4, wherein the phenolic compound is present in the range of 20 to 100 wt% based on the weight of the organic acid.

6. A heat-sensitive recording paper as claimed in claim 1, wherein the organic acid is selected from the group consisting of phenol derivatives and aromatic carboxylic acid derivatives.

7. A heat-sensitive recording paper as claimed in claim 1, wherein the organic acid is a bisphenol.

* * * * *